US005636581A

United States Patent [19]

Kleen et al.

[11] Patent Number: 5,636,581

[45] Date of Patent: Jun. 10, 1997

[54] GRATE BAR AND GRATE WITH COOLING APPARATUS AND PROCESS FOR COOLING

[75] Inventors: Holger Kleen, Castrop-Rauxel; Hans-Günther Mayer, Veitshöchheim; Wolfram Schnabel, Höchberg, all of Germany

[73] Assignee: NOELL Abfall-Und Energietechnik GmbH, Neuss, Germany

[21] Appl. No.: 371,096

[22] Filed: Jan. 10, 1995

[30] Foreign Application Priority Data

Jan. 14, 1994 [DE] Germany ..... 44 00 992.5

[51] Int. Cl.[6] ..... F23H 11/10

[52] U.S. Cl. ..... 110/270; 110/299; 110/328; 110/348; 126/163 R

[58] Field of Search ..... 110/101 A, 299, 110/270, 285, 328, 348; 126/152 R, 167, 152 B, 163 R

[56] References Cited

U.S. PATENT DOCUMENTS

| | | | |
|---|---|---|---|
| 890,552 | 6/1908 | Bibb | 126/152 R |
| 1,775,790 | 9/1930 | Tawlks | 126/163 R |
| 4,870,913 | 10/1989 | Schneider | 126/163 R X |
| 5,103,744 | 4/1992 | Tunstromer | 110/233 |

FOREIGN PATENT DOCUMENTS

| | | |
|---|---|---|
| 0071681 | 2/1983 | European Pat. Off. . |
| 739654 | 1/1933 | France . |
| 498538 | 5/1930 | Germany . |
| 808263 | 7/1951 | Germany . |
| 515691 | 12/1953 | Germany . |
| 2106613 | 4/1990 | Japan . |
| 684118 | 7/1994 | Switzerland . |
| 94/18502 | 8/1994 | WIPO . |

*Primary Examiner*—Henry A. Bennett
*Assistant Examiner*—Susanne C. Tinker
*Attorney, Agent, or Firm*—Cohen, Pontani, Lieberman, Pavane

[57] ABSTRACT

Fluid-cooled grate bars and grates for use in a combustion furnace such as a garbage incineration plant and a process for cooling the grate bars and grates. The grate bar has a duct defined therewithin for guiding a coolant supplied by a fluid-cooling apparatus. The primary coolant is preferably water. Steam formation is prevented by pressurizing the water. Additional or replacement coolant such, for example, as air may be employed for the grate bars and grates.

10 Claims, 6 Drawing Sheets

GRATE BAR AND GRATE WITH COOLING APPARATUS AND PROCESS FOR COOLING

BACKGROUND OF THE INVENTION

1. Field of the Invention

The present invention relates to grate bars and grates for combustion furnaces and, in particular, to a fluid-cooled grate bar having a duct defined therewithin for guiding a coolant, a grate constructed with these grate bars, and a process for cooling a grate bar and a grate.

2. Description of the Prior Art

Conventional grates employed in combustion furnaces such as a garbage incineration plant are formed by rows of grate bars with each row being arranged one above another and extended transversely to the transporting or feeding direction of the combustible materials such, for example, as garbage. The grate bars are typically provided with openings such, for example, as slots, gaps, and holes so that air can be blown therethrough to aid combustion. The grate bars, besides transporting and mixing (known as stoking) combustible materials, also remove by-products of combustion. Additionally, the processes of drying, preheating, degassing, gasifying and carbon-burning are carried out successively on the grate bars.

The grate bars must provide desirable fire control and combustion characteristics, and be able to withstand harsh conditions in the use environment. These objectives, however, are difficult to meet. During use, wear is induced on the grate bars and grates by a myriad of environmental stresses from such, for example, as static and impact loading of massive combustible materials, caustic chemical attacks by hazardous substances, and thermal cycling from combustion to ambient conditions.

The wear on the grate bars depends substantially on their temperature during use. It is well known that the wear on the grate bars adversely affects the fire control and combustion characteristics of the grates and shortens the life expectancy of the grates. The operation of the furnace could be disrupted if the grams and grate bars experience structural failure.

Conventional measures taken to minimize the wear on the grates during combustion include supplying a portion of the combustion air —known as primary air —to cool the grates. According to this method, cooling is principally achieved by regulating the supply of combustion air. The remaining portion of the combustion air, or secondary air, is used to aid combustion of gases in the furnace chamber.

Fire control characteristics and/or quality of combustion of a garbage incineration plant can be affected by the composition of the garbage. In particular, domestic garbage destined for a garbage incineration plant often contains materials with elevated heat values such, for example, as recyclable glass, biodegradable substances or vegetable waste, and plastics. The elevated heat values and/or variations of the range of heat values of the garbage constituents increase the temperature of the grates —not only because of the increased intensity of the combustion, but also the decreased cooling caused by diminished air flow across the grates. The high heat values of the combustible garbage materials also tend to cause the combustion air to redistribute such that a larger quantity of combustion air is required for the combustion of gases in the furnace chamber.

SUMMARY OF THE INVENTION

An object of the present invention is to provide fluid-cooled grate bars and grates for use in a furnace chamber which incinerates materials having high heat values, which grate bars and grates resist wear while maintaining desirable combustion, transporting and mixing characteristics.

Another object of the invention is to enable the use of water as a primary or first coolant and to maintain coolant temperature to less than 100° C. and, preferably, less than 50° C.

Yet another object of the invention is to provide good emergency operating capabilities to a grate, in the event the supply of primary or first coolant is interrupted, by enabling a secondary or second coolant such, for example, as air to cool the grate bars and grates.

Still another object is to prevent the formation of steam in a water cooling system for the grate bars and grates by pressurizing the cooling water.

A grate bar, in accordance with the present invention, is cooled by a cooling fluid provided therewithin so as to increase reliability thereof. The grate bar advantageously has at least one inlet and one outlet opening and at least one duct therewithin for guiding the cooling fluid to flow substantially along the longitudinal direction of the grate bar. Cooling of the grate bars is advantageously achieved since the longitudinal direction of each grate bar corresponds to the material feed direction. Overall heating of the cooling fluid can be kept to a minimum by cooling individual grate bars. This particular cooling scheme increases the reliability, i.e., the useful life, of the cooling apparatus and the grates. Water is the preferred primary coolant, though other coolants with higher boiling temperatures may also be used for other applications. It is also contemplated that additives such, for example, as the commonly known antifreeze be added to the water to increase the boiling temperature of the resulting mixture and thus prevent formation of steam in the duct and/or the cooling system.

In accordance with the present invention, the duct in a grate bar preferably has a first and second approximately or substantially parallel portions, the portions being connected by a baffle or return portion so that a cooling fluid such, for example, as water flows through the first portion and comes back through the second portion in a substantially opposite direction via the return portion. The first and second portions of the duct can be arranged beside or atop each other in a horizontal or vertical plane, respectively. The duct can be provided, through the skills of an ordinary artisan, with optimal heat transfer and flow properties, including flow rates and pressure drops, so that the coolant is not heated to more than 50° C. and, preferably, to approximately 20° C. If in a particular embodiment the first and second portions of a duct are arranged one atop another, the first and second portions could have different cross-sectional shapes and areas. The return portion may be arranged in the head region of the grate bar and may lie in the plane which cuts across the longitudinal axes of the first and second portions of the cooling duct.

The return portion is preferably located in the head region and along an edge of the grate bar. It is constructed so as to be approximately U-shaped in the region of the head of the grate bar.

In another embodiment, the inlet and outlet openings for the primary coolant are arranged at the foot region of the grate bar proximate the support thereof.

Cooling of the grate bars and grates may be further improved by providing additional air outlet openings for combustion air, which openings preferably are arranged in the head region of the grate bar. According to one embodiment, clearances or apertures for exiting combustion air are arranged along the longitudinal sides of the grate bar.

According to yet another embodiment, there is provided a closed cooling system which includes an expansion or compensation vessel, fluid-cooled grate bars, a recooling device, a pump, a connection for filling and emptying the cooling system, and a pressure control valve. The closed cooling system may use water as the primary coolant and operate at overpressure or above-atmospheric pressure. An ordinary artisan would readily appreciate based on the inventive features disclosed herein, that such overpressure is desirable if steam formation within the cooling system including the ducts of the grate bars is to be prevented. The range of pressure in such a system is preferably between 1 and 6 bar so as to preclude a two-phase flow (or the formation of "steam cushions") within the duct or the cooling system, which impede heat transfer from the grate bars to the coolant.

In accordance with an embodiment of the invention, the grate bars for garbage incinerators may be arranged as adjacent rows of alternately stationary and movable rows of grate bars. In addition, the inlet and outlet openings of the grate bars can be connected in parallel to a main inlet and outlet line. According to this flow scheme, uniform cooling can be achieved for all grate bars. Thus, assuming equal or uniform thermal loading, every grate bar would have substantially the same temperature distribution and thus the same thermal expansion.

In some applications, certain grate bars lying adjacent one another in the direction of the width of the grate can be interconnected in series so as to advantageously adapt cooling to non-uniform thermal loadings such, for example, as in the case where the thermal loading at the center is different from that near the edge regions of the gram. Thus, for example, in a particular grate construction with fourteen adjacent grate bars, the inlet openings of the first, sixth and eleventh grate bars are connected to the main inlet line while the outlet openings of the fifth, tenth and fourteenth grate bars are connected to the main outlet line. The remaining inlet and outlet openings of adjacent grate bars are connected with one another, correspondingly. In this manner, cooling is provided to individual rows of stationary and movable grate bars.

In accordance with another embodiment of the invention, there are provided valves for feeding and discharging either an additional or replacement (i.e., secondary) coolant such, for example, as air, and for interrupting or regulating the supply of coolant from the main inlet or to the main outlet line. The valves may, for example, be located upstream of the main inlet opening and downstream of the main outlet opening of the first and last grate bars of a row of grate bars, or of a partial region of a row of grate bars in which the inlet and outlet openings of the individual grate bars are connected with one another in series. In the event of leakage of the primary coolant from one or more grate bars, the secondary coolant could enable the continuation of furnace operation until the next scheduled maintenance stoppage. Furthermore, rows of grate bars with low thermal loading can be advantageously cooled with air, a less expensive coolant than water. A particularly economical embodiment provides a grate zone formed by rows of grate bar connected in parallel with joint inlet and outlet lines, which lines are in turn connected to valves for feeding and discharging the secondary coolant, and which valves are connected to a shut-off to the main inlet and outlet line.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
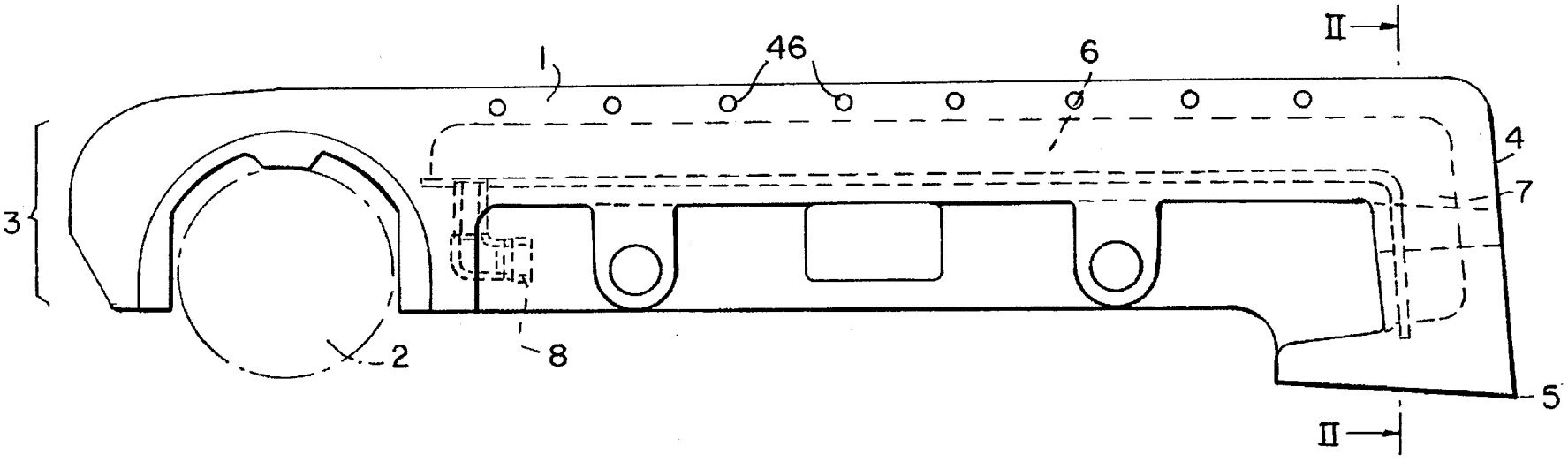
FIG. 1 is a side view of the longitudinal side of the gram bar in accordance with the present invention.

As can be seen in FIG. 1, there is shown a grate bar 1 having a foot 3 and head region 4. The grate bar 1 has a grate bar support 2 at the foot region 3. During operation, the grate bar head 4 has an edge 5 which lies atop another grate bar of an adjacent row of grate bars. The grate bar 1 is preferably made of cast iron.

Figure 2:
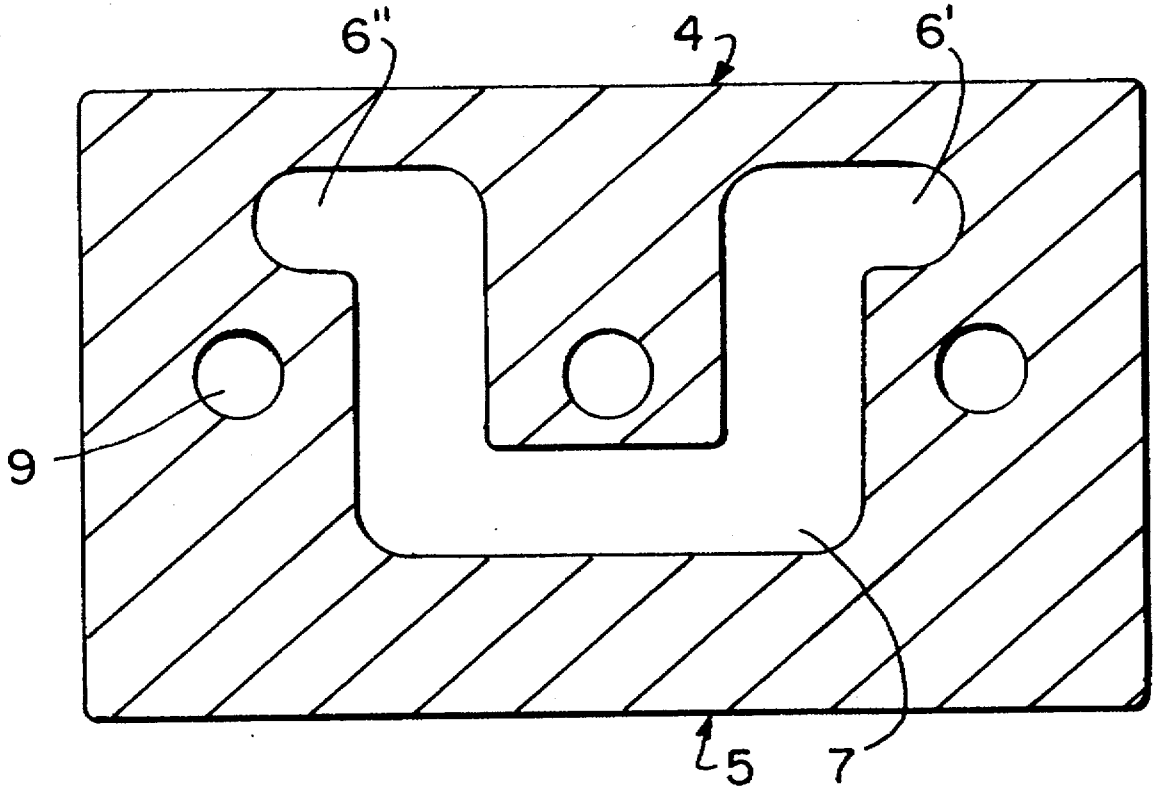
FIG. 2 is a sectional view of an embodiment of the return portion of a grate bar along line II—II of FIG. 1.
Figure 3:
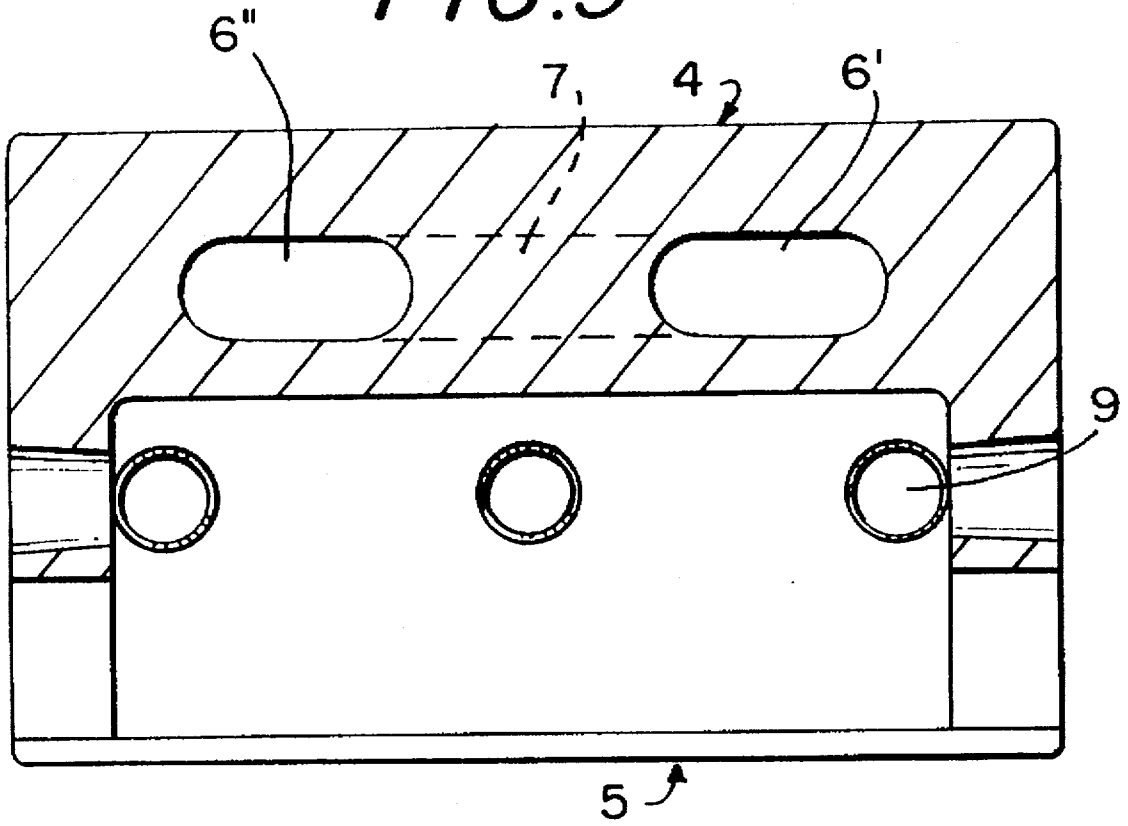
FIG. 3 is a sectional view along line II—II of FIG. 1 for another embodiment of the return portion which lies along the same plane as that of the parallel portions of the cooling duct.

The grate bar 1, in accordance with the present invention, includes therewithin a duct 6 having a first 6' and second portion 6", as is shown in FIGS. 2 and 3. FIG. 1 illustrates that the first and second portions are connected with one another through a return portion 7. The duct 6 has inlet and outlet openings 8. These inlet and outlet openings 8 are preferably arranged side-by-side and located directly at the end of the duct 6 proximate the foot portion 3. The various possible arrangement and configurations for these inlet and outlet openings 8 are well within the skills of an ordinary artisan.

FIG. 2 depicts a sectional view along line II—II of FIG. 1 through the grate bar head 4 of the grate bar 1. The first 6' and second portions 6" may be substantially or approximately parallel to each other and open into the return portion 7. The return portion 7 may be substantially U-shaped in the plane along line II—II and positioned proximate the lower edge 5 of the grate bar head 4. Air openings 9 may, for example, be provided between and along the sides of the legs of the substantially U-shaped return portion 7, and near the head portion 4.

FIG. 3 shows a sectional view along line II—II of FIG. 1 for another embodiment of the invention in which the return portion 7 does not extend downward and proximate the edge region 5. Rather, in this particular embodiment, the return portion 7, together with the first 6' and second duct portions 6", may be configured as a roughly U-shaped cross section in substantially the same plane as that of the first 6' and second duct portions 6". It is further contemplated that the first duct portion 6' may be positioned above the second duct portion 6" with the return portion 7 extending from top to bottom.

Figure 4A:
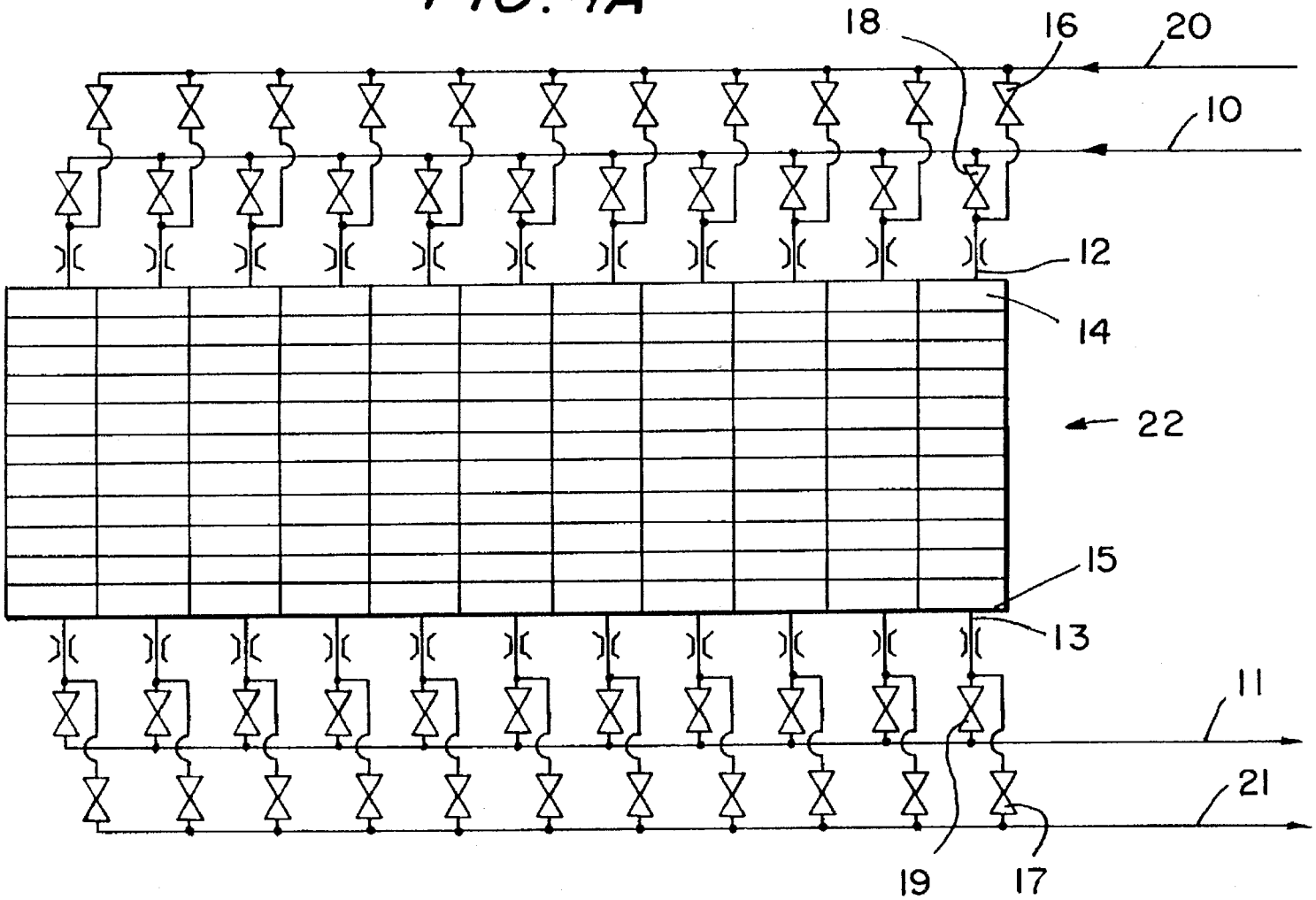
FIG. 4A is a schematic flow chart of a grate having an arrangement of valves for feeding and discharging a first and second coolant.

FIG. 4A illustrates a schematic flow chart of a grate according to a preferred embodiment of the invention. As shown, the primary (or first) coolant such, for example, as water can be fed through the main inlet line 10, across a plurality of main inlet valves 18, into an inlet opening 12, then into a first grate bar 14, through the plural grate bars and the last grate bar 15, out through the plural outlet openings 13, across the main outlet valves 19, and into the main outlet line 11. A secondary (or second) coolant such, for example, as air may be used—in addition to or as a replacement of the primary (or first) coolant - to cool the grate. The secondary (or second) coolant can be fed through a main feed line 20, across a plurality of feeding valves 16, into plural inlet openings 12, through the first grate bar 14 and the plural grate bars, out through plural outlet openings 13, across the discharge valves 17, and into the main discharge line 21. Thus, an ordinarily skilled person would readily appreciate that the grate bar 1 and grate have emergency handling capabilities in the event the supply of the primary coolant is interrupted. FIG. 4A further illustrates the preferred flow direction of the combustible or garbage material as is indicated by arrow 22.

Figure 4C:
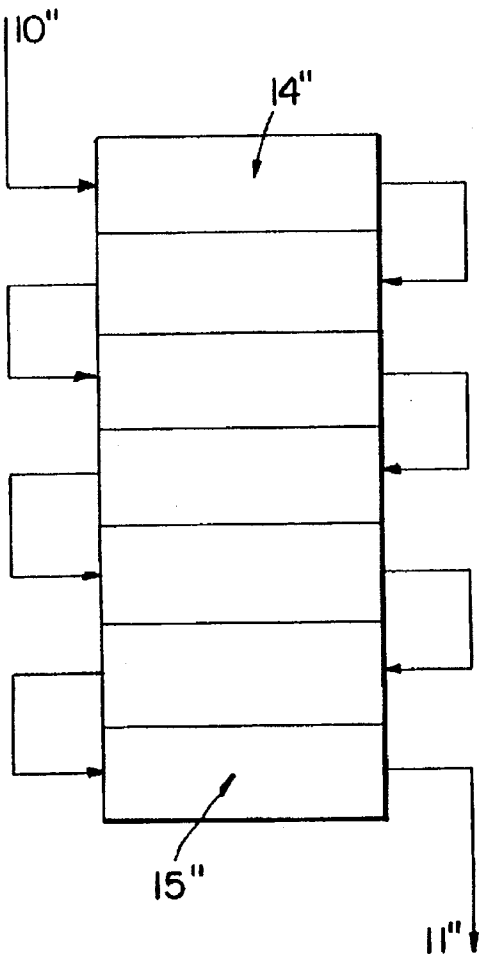
FIG. 4C is another schematic flow chart showing yet another embodiment of the present invention wherein the grate bars and the main inlet and outlet lines are connected in series.
Figure 4B:
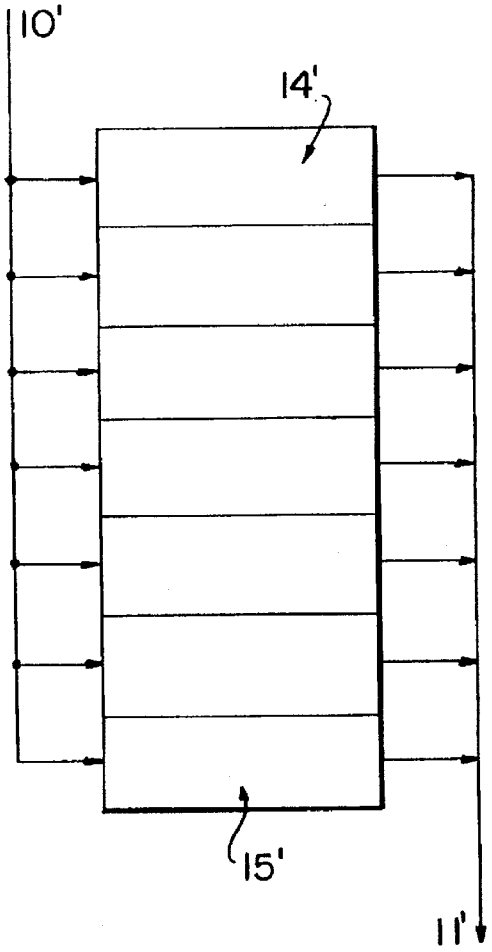
FIG. 4B is a schematic flow chart showing still another embodiment of the present invention wherein the grate bars and the main inlet and outlet lines are connected in parallel.

FIG. 4B is a schematic flow chart illustrating still another embodiment of the present invention. As seen, a plurality of grate bars including grate bars 14', 15' are connected in parallel with the main inlet line 10' and main outlet line 11'.

FIG. 4C is also a schematic flow chart depict yet another embodiment of the present invention. As illustrated, the plurality of grate bars including grate bars 14", 15" are connected in series with the main inlet line 10" and main outlet line 11".

The grate bars and grate, in accordance with the invention, can be advantageously implemented without further modification to a conventional incineration plant. Thus, the present invention can be employed within the scope of conventional incinerator technology. Also, mechanical transporting and mixing behavior (e.g. forward and return stroke) of the grate remains unchanged. This holds true with respect to the weight as well as to the stroke. Moreover, the grate is extremely resistant to wear since it is made of cast iron.

The grate bar 1 preferably has a conventional shape or configuration. The width of the grate bar 1 may, for example, be approximately double that of a conventional grate bar so as to provide the requisite flow passage areas for duct portions 6' and 6". Thus, each of the parallel portions 6' and 6" of the duct 6 may, for example, take up an entire width of a conventional grate bar thereby causing the grate bar 1 to have a width that is twice that of a conventional grate bar.

In a particular embodiment, the parallel duct portions 6' and 6" preferably have a clearance height of approximately 15 mm to 25 mm and a clearance width of approximately 40 mm to 60 mm. The coolant flow rate is preferably between 0.5 m and 2 m per second. The mid-span temperature of the grate bar 1 is preferably around 100° C. so that condensation-caused corrosion may be prevented. A temperature of approximately 150° C. may be maintained in the region of the head 4 of the grate bar 1 so as to avoid any disadvantages relating to burnup behavior.

In another particular embodiment, the grate bars 1 and grate are integrated and operated with a pressurized water cooling system. The water temperature may, for example, be 90° C. but can be as high as 120° C.; the system pressure may be between 1 and 6 bar but, preferably, at about 5 bar.

In yet another embodiment, as is illustrated in FIG. 1, the grate bar may comprise clearances or apertures 46 arranged in and/or along longitudinal sides of the grate bar 1 so as to allow a secondary coolant, such as air, to exit.

Figure 5:
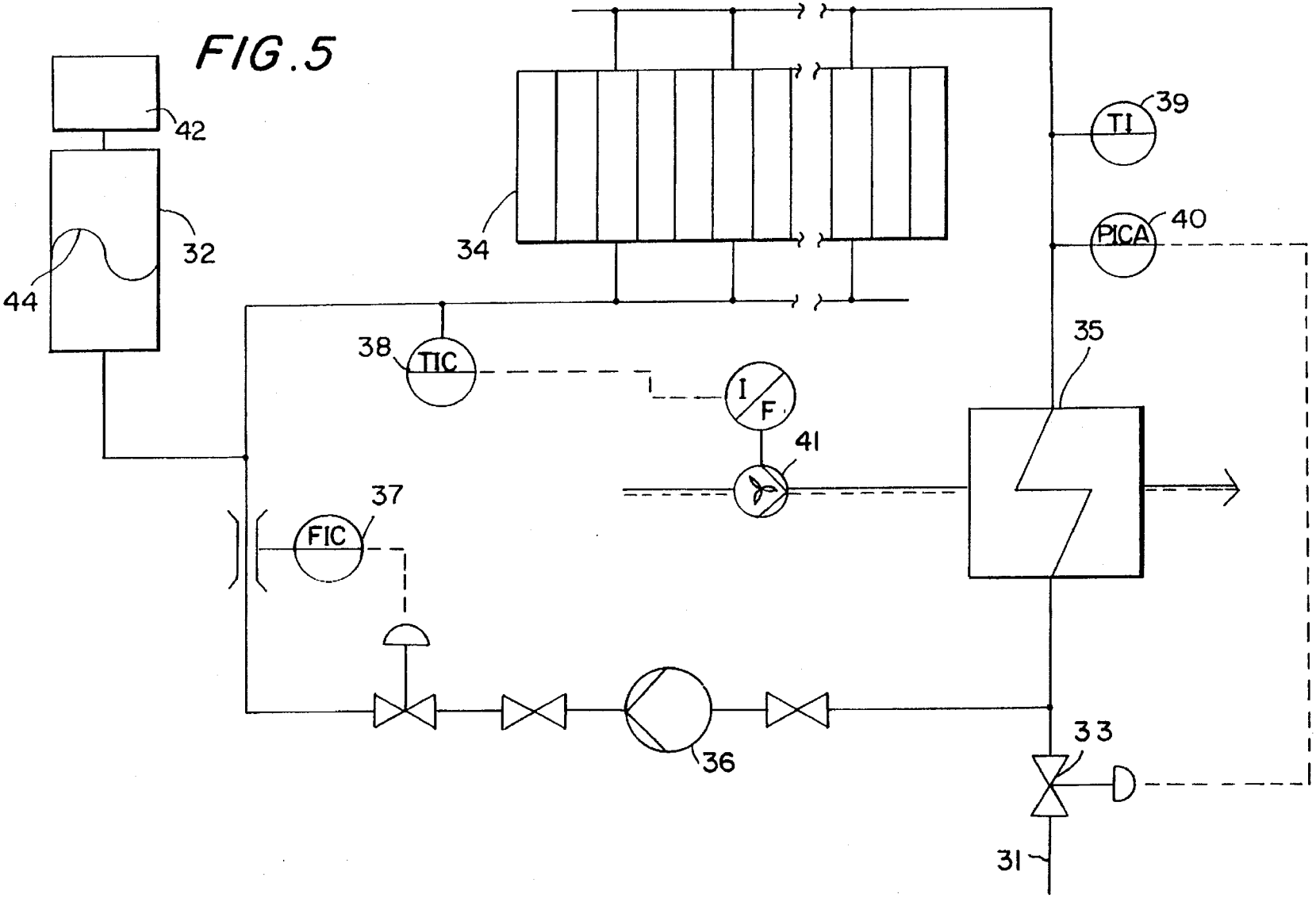
FIG. 5 is a schematic diagram of the cooling system for cooling the grate bars and grate.

As shown in FIG. 5, the cooling system pressure may be adjusted via a compressor 42 delivering compressed air to a region in an expansion or compensation vessel 32, which region is separated from the coolant by a diaphragm 44 in the vessel 32. Preferably, the diaphragm 44 is made of rubber so that the cooling water is advantageously prevented from absorbing oxygen —an element that may cause detrimental corrosion or oxidation inside the grate bar ducts 6. As would an ordinarily skilled person readily appreciate, the cooling system pressure may be adjusted via an automatic expansion device preferably integrated in the expansion vessel 32. The automatic expansion device may, for example, be operated as follows: a contact manometer detecting a minimum system threshold pressure such, for example, as 1.0 bar would activate the compressor 42 to increase coolant pressure and then deactivate compressor 42 when an adjustable upper threshold pressure, preferably about 6.0 bar, is reached; if coolant pressure exceeds the pre-selected upper threshold pressure, surplus air may be exhausted via a relief valve. In short, the automatic expansion device switches the compressor 42 on and off at around 1.0 and 6.0 bar, respectively.

FIG. 5 further illustrates schematically the various components of an embodiment of a cooling system. As can be seen, the coolant such, for example, as water is fed to the cooling system through connection 31. A pressure control valve 33 protects the cooling system from being overpressurized by the coolant supply source. A threshold pressure is preferably set at about 2 bar. A pump 36 delivers the cooling water through the grate bars 1, grate 34 and the cooling system. The expansion or compensation vessel 32 may be provided with a level gauge so that additional quantities of water can be automatically fed into the cooling system when the level of cooling water falls below a minimum threshold value. Preferably simultaneously, a maintenance alert may be transmitted to a monitoring station. When an upper threshold value is reached, the supply of water is automatically shut off. Leakage in the cooling system can be detected based on the frequency of maintenance alerts so that appropriate remedial measures can be taken. One remedial measure, for example, is to shut off coolant flow to individual grate bars 1 or rows of grate bars.

As is shown in FIG. 5, there may be incorporated additional monitoring sensors such, for example, as a volumetric flow monitor 37 for measuring the mass rate of flow of water, temperature gauges 38 and 39 for monitoring the inlet and outlet temperature of the cooling water passing through the grate 34, and a pressure sensor 40 for measuring the pressure in the cooling system. The cooling system may further be provided with a recooling device comprising a ventilator 41 and a heat exchanger 35 for cooling the heated coolant.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A fluid-cooled grate for a combustion furnace, comprising:

a plurality of fluid-cooled grate bars, each said grate bar having a duct extending substantially longitudinally therewithin for guiding a first coolant, each said duct having an inlet and outlet opening for feeding and discharging the first coolant, said plurality of grate bars being arranged in adjacent alternatingly stationary and moveable rows; and a main fluid inlet line and a main fluid outlet line, each said inlet and outlet opening of each said duct of each said grate bar being connected with said main fluid inlet line and said main fluid outlet line, respectively, wherein said plural grate bars are connected in parallel to the main fluid inlet line and the main fluid outlet line for fluid communication therewith.

2. The grate as recited in claim 1, further comprising closed cooling means for cooling the coolant at above-atmospheric pressure, the cooling means including a compressor and expansion vessel.

3. The grate as recited in claim 1, further comprising first valve means connected between the main inlet line and an inlet opening of a first grate bar of a row of said plural grate bars for selectively feeding a second coolant into said first grate bar and interrupting a first coolant into said first grate bar from the main inlet line, and second valve means connected between the main outlet line and an outlet opening of a last grate bar of a row of said plural grate bars for selectively discharging a second coolant and interrupting the first coolant from said last grate bar to the main outlet line, said each grate bar being correspondingly connected to another in series for fluid communication therewith.

4. The grate as recited in claim 1, wherein said plural grate bars are connected to each other in parallel so as to form at least one grate zone, further comprising a joint inlet line and a joint outlet line, first valve means for feeding a second coolant to said grate zone from said joint inlet line, second valve means for discharging the second coolant from said grate zone to said joint outlet line.

5. The grate as recited in claim 4, wherein the second coolant is air.

6. The grate as recited in claim 1, further comprising closed cooling means for cooling the coolant at above-atmospheric pressure so as to preclude a two-phase flow within said ducts of said grate bars, the cooling means including a compressor and expansion vessel.

7. The grate as recited in claim 1, wherein each grate bar has a head region in which the inlet opening is arranged, and a longitudinal side wall adjacent the duct, an aperture being arranged to extend through at least one of the head region and the longitudinal side wall for permitting air to exit.

8. A process for direct-cooling of a plurality of grate bars, each of the bars having a duct extending substantially longitudinally therewithin for guiding a coolant fluid, which comprises the steps of:

arranging the plurality of grate bars in adjacent alternatingly stationary and moveable rows;

connecting the ducts of the plurality of grate bars in parallel to a main fluid inlet line and a main fluid outlet line for fluid communication therewith;

pressurizing a coolant fluid in a cooling apparatus to an above-atmospheric pressure so as to preclude two-phase flow in the ducts of the grate bars; and directing the coolant fluid to flow through the plurality of grate bars.

9. The process according to claim 8, wherein the pressure is adjustable by selectively activating a compressor, which compressor acts upon the coolant fluid through an expansion vessel.

10. A fluid-cooled grate for a combustion furnace, comprising:

a plurality of fluid-cooled grate bars, each said grate bar having a duct extending substantially longitudinally therewithin for guiding a first coolant, each said duct having an inlet and outlet opening for feeding and discharging the first coolant, said plurality of grate bars being arranged in adjacent alternatingly stationary and moveable rows; and a main fluid inlet line and a main fluid outlet line, each said inlet and outlet opening of each said grate bar being connected with said main fluid inlet line and said main fluid outlet line, respectively, wherein said plural grate bars are connected in series to the main fluid inlet line and the main fluid outlet line for fluid communication therewith, and further comprising closed cooling means for cooling the coolant at above-atmospheric pressure so as to preclude a two-phase flow within said ducts of said grate bars, the cooling means including a compressor and expansion vessel.

* * * * *